US005403693A

United States Patent [19]

Patel et al.

[11] Patent Number: 5,403,693

[45] Date of Patent: Apr. 4, 1995

[54] TONER AGGREGATION AND COALESCENCE PROCESSES

[75] Inventors: Raj D. Patel, Oakville; Grazyna E. Kmiecik-Lawrynowicz, Burlington; Michael A. Hopper, Toronto, all of Canada

[73] Assignee: Xerox Corporation, Stamford, Conn.

[21] Appl. No.: 83,157

[22] Filed: Jun. 25, 1993

[51] Int. Cl.[6] ..... G03G 9/087

[52] U.S. Cl. ..... 430/137; 430/111; 523/335; 523/346; 523/352; 528/936

[58] Field of Search ..... 430/137; 523/335, 346, 523/352; 528/936

[56] References Cited

U.S. PATENT DOCUMENTS

| | | | |
|---|---|---|---|
| 4,052,353 | 10/1977 | Scanley | 523/335 |
| 4,137,188 | 1/1979 | Uetake et al. | 252/62.1 P |
| 4,299,952 | 11/1981 | Pingel et al. | 528/936 |
| 4,487,857 | 12/1984 | Suginori et al. | 523/335 |
| 4,558,108 | 12/1985 | Alexandru et al. | 526/340 |
| 4,668,738 | 5/1987 | Lee et al. | 523/335 |
| 4,797,339 | 1/1989 | Maruyama et al. | 430/109 |
| 4,831,116 | 5/1989 | Henton | 528/936 |
| 4,983,488 | 1/1991 | Tan et al. | 430/137 |
| 4,996,127 | 2/1991 | Hasegawa et al. | 430/109 |
| 5,064,938 | 11/1991 | Suzuki et al. | 523/335 |
| 5,262,269 | 11/1993 | Nair et al. | 430/137 |

*Primary Examiner*—Christopher D. Rodee
*Attorney, Agent, or Firm*—E. O. Palazzo

[57] ABSTRACT

A process for the preparation of toner compositions with controlled particle size comprising:

(i) preparing a pigment dispersion in water, which dispersion is comprised of a pigment, an ionic surfactant in amounts of from about 0.5 to about 10 percent by weight of water, and an optional charge control agent;

(ii) shearing the pigment dispersion with a latex mixture comprised of a counterionic surfactant with a charge polarity of opposite sign to that of said ionic surfactant, a nonionic surfactant, and resin particles, thereby causing a flocculation or heterocoagulation of the formed particles of pigment, resin, and charge control agent;

(iii) stirring the resulting sheared viscous mixture of (ii) at from about 300 to about 1,000 revolutions per minute to form electrostatically bound substantially stable toner size aggregates with a narrow particle size distribution;

(iv) reducing the stirring speed in (iii) to from about 100 to about 600 revolutions per minute, and subsequently adding further anionic or nonionic surfactant in the range of from about 0.1 to about 10 percent by weight of water to control, prevent, or minimize further growth or enlargement of the particles in the coalescence step (iii); and (v) heating and coalescing from about 5 to about 50° C. above about the resin glass transition temperature, Tg, which resin Tg is from between about 45° C. to about 90° C. and preferably from between about 50° C. and about 80° C. the statically bound aggregated particles to form said toner composition comprised of resin, pigment and optional charge control agent.

34 Claims, No Drawings

TONER AGGREGATION AND COALESCENCE PROCESSES

BACKGROUND OF THE INVENTION

The present invention is generally directed to toner processes, and more specifically to aggregation and coalescence processes for the preparation of toner compositions. In embodiments, the present invention is directed to the economical preparation of toners without the utilization of the known pulverization and/or classification methods, and wherein toners with an average volume diameter of from about 1 to about 25, and preferably from 1 to about 10 microns and narrow GSD can be obtained. The resulting toners can be selected for known electrophotographic imaging and printing processes, including color processes, and lithography. In embodiments, the present invention is directed to a process comprised of dispersing a pigment and optionally a charge control agent or additive in an aqueous mixture containing an ionic surfactant in amount of from about 0.5 percent to about 10 percent and shearing this mixture with a latex mixture comprised of suspended resin particles of from about 0.01 micron to about 2 microns in volume average diameter in an aqueous solution containing a counterionic surfactant in amounts of from about 1 percent to about 10 percent with opposite charge to the ionic surfactant of the pigment dispersion, and nonionic surfactant in amount of from 0 percent to about 5 percent, thereby causing a flocculation of resin particles, pigment particles and optional charge control particles, followed by stirring of the flocculent mixture which is believed to form statically bound aggregates of from about 1 micron to about 10 microns, comprised of resin, pigment and optionally charge control particles, and thereafter, adding extra anionic or nonionic surfactant solution with a concentration of from about 5 percent to about 30 percent in the controlled amount, which will result in the overall final concentration of this surfactant in the aggregated mixture of from about 0.5 percent to about 10 percent, and preferably from 1 percent to 5 percent (weight percent throughout unless otherwise indicated) to thereby enable any further growth in particle size and GSD during the heating step, which size in embodiments is from about 3 to about 10 microns in average volume diameter, and with a GSD of from about 1.16 to about 1.26; and then heating the mixture above the polymeric resin Tg, which Tg is in range of from between about 45° C. to about 90° C. and preferably between about 50° C. and 80° C., and more preferably the resin Tg is equal to 54° C., to generate toner with an average particle volume diameter of from about 1 to about 10 microns, and wherein the stirring speed in (iii) is reduced from about 300 to about 1,000 to about 100, preferably 150, to about 600 rpm, primarily to substantially eliminate fines of about 1 micron in average volume diameter, which fines can adversely affect toner yield. It is believed that during the heating stage, the components of aggregated particles fuse together to form composite toner particles. In another embodiment thereof, the present invention is directed to an in situ process comprised of first dispersing a pigment, such as HELIOGEN BLUE™ or HOSTAPERM PINK™, in an aqueous mixture containing a cationic surfactant, such as benzalkonium chloride (SANIZOL B-50™), utilizing a high shearing device, such as a Brinkmann Polytron, or microfluidizer or sonicator, thereafter shearing this mixture with a charged latex of suspended resin particles, such poly(styrene/butadiene/acrylic acid) or poly(styrene/butylacrylate/acrylic acid) or PLIOTONE™ of poly(styrene butadiene), and of particle size ranging from about 0.01 to about 0.5 micron as measured by the Brookhaven nanosizer in an aqueous surfactant mixture containing an anionic surfactant, such as sodium dodecylbenzene sulfonate (for example NEOGEN R™ or NEOGEN SC™) and nonionic surfactant, such as alkyl phenoxy poly(ethylenoxy) ethanol (for example IGEPAL 897™ or ANTAROX 897™), thereby resulting in a flocculation, or heterocoagulation of the resin particles with the pigment particles; and which on further stirring for from about 1 hour to about 24 hours with optional heating at from about 5° to about 25° C. below the resin Tg, which Tg is in the range of between 45° to 90° C. and preferably between about 50° and 80° C., results in formation of statically bound aggregates ranging in size of from about 0.5 micron to about 10 microns in average diameter size as measured by the Coulter Counter (Microsizer II); and adding concentrated (from about 5 percent to about 30 percent) aqueous surfactant solution containing an anionic surfactant, such as sodium dodecylbenzene sulfonate (for example NEOGEN R™ or NEOGEN SC™) or nonionic surfactant such as alkyl phenoxy poly(ethylenoxy) ethanol (for example IGEPAL 897™ or ANTAROX 897™), in controlled amounts to prevent any changes in particle size, which can range from 3 to 10 microns in average volume diameter and a GSD which can range from about 1.16 to about 1.28 during the heating step, and thereafter, heating to 10° to 50° C. above the resin Tg to provide for particle fusion or coalescence of the polymer and pigment particles; followed by washing with, for example, hot water to remove surfactants, and drying whereby toner particles comprised of resin and pigment with various particle size diameters can be obtained, such as from 1 to 12 microns in average volume particle diameter, and wherein the stirring speed in (iii) is reduced in (iv) as illustrated herein. The aforementioned toners are especially useful for the development of colored images with excellent line and solid resolution, and wherein substantially no background deposits are present. While not being desired to be limited by theory it is believed that the flocculation or heterocoagulation is formed by the neutralization of the pigment mixture containing the pigment and cationic surfactant absorbed on the pigment surface, with the resin mixture containing the resin particles and anionic surfactant absorbed on the resin particle. The high shearing stage disperses the large initially formed flocculants, and speeds up formation of stabilized aggregates negatively charged and comprised of the pigment and resin particles of about 0.5 to about 10 microns in volume diameter. Thereafter, extra or additional anionic surfactant percent, such as about 0.1 to about 5 weight based on the total weight of all components, can be added to increase the negative charge on the surface of the aggregated particles, thus increasing their stability, electrostatically, and preventing any further change in particle size (growth) of the aggregates during the heating stage, or coalescence step. Thereafter, heating is applied to fuse the aggregated particles or coalesce the particles to toner composites or particles comprising resin, pigment, and optional charge control agents (CCA). Furthermore, in other embodiments the ionic surfactants can be exchanged, such that the pigment mixture contains the pigment particle and anionic surfactant, and the suspended resin particle mixture contains the resin particles and cationic surfactant; followed by the ensuing steps as illustrated herein to enable flocculation by charge neutralization while shearing, and form statically bounded aggregate particles by stirring, stabilization of the above mentioned aggregate particles by addition of extra surfactant prior to heating, and toner formation after heating. Of importance with respect to the processes of the present invention in embodiments, in addition to reducing the stirring speeds, is controlling the amount of anionic or nonionic surfactant added to already formed aggregates to ensure, for example, that the dispersion of aggregated particles remains stable and thus can be effectively utilized in the coalescence process, and to enable the control of particle size in the coalescence step. More specifically, the method of formation of aggregated toner size particles from submicron size resin particles and submicron size pigment size results from these components being dispersed in oppositely charged surfactants, for example, the latex is a dispersion of polymeric particles in anionic surfactant, and the pigment can be dispersed in cationic surfactant. Aggregated particles are formed due to the partial charge neutralization of the surface of the latex particles, and aggregates, which are formed in the aggregation process, are negatively charged in embodiments and relatively stable, that is they are stable enough to withstand particle size measurements on the Coulter Counter, which requires addition of the electrolyte to perform the measurement, however, they may not be stable enough to withstand heating above the polymeric resin Tg, which is required to fuse resin and pigment particles together to form the toner composite. The addition of this extra portion of anionic or nonionic surfactant prior to heating increases the negative charge on the aggregated particles, thus enhancing the stability of the aggregated system to such an extent that the aggregated particles can retain their particle size and particle size distribution during the coalescence step. This can be important, especially for preparation of small toner composite particles, since one can control particle growth in the aggregation step and retain those particles through the heating stage. By adding extra anionic or nonionic surfactant to the already formed aggregated particles to stabilize the new colloidal system, either by electrosteric or steric stabilization, the system is of sufficient stability to withstand additional heating that is selected to coalesce the electrostatically bound aggregates. Without addition of this extra stabilizer, the particles may in embodiments have the tendency to further grow and multiply their size.

In reprographic technologies, such as xerographic and ionographic devices, toners with average volume diameter particle sizes of from about 9 microns to about 20 microns are effectively utilized. Moreover, in some xerographic technologies, such as the high volume Xerox Corporation 5090 copier-duplicator, high resolution characteristics and low image noise are highly desired, and can be attained utilizing the small sized toners of the present invention with an average volume particle of less than 11 microns and preferably less than about 7 microns, and with narrow geometric size distribution (GSD) of from about 1.16 to about 1.3. Additionally, in some xerographic systems wherein process color is utilized, such as pictorial color, small particle size colored toners of from about 3 to about 9 microns are highly desired to avoid paper curling. Paper curling is especially observed in pictorial or process color applications wherein three to four layers of toners are transferred and fused onto paper. During the fusing step, moisture is driven off from the paper because of the high fusing temperatures of from about 130° to 160° C. applied to the paper from the fuser. Where only one layer of toner is present, such as in black or in highlight xerographic applications, the amount of moisture driven off during fusing is reabsorbed proportionally by paper, and the resulting print remains relatively flat with minimal curl. In pictorial color process applications wherein three to four colored toner layers are present, a thicker toner plastic level present after the fusing step inhibits the paper from sufficiently absorbing the moisture lost during the fusing step, and image paper curling results. These and other disadvantages and problems are avoided or minimized with the toners and processes of the present invention. It is preferable to use small toner particle sizes, such as from about 1 to 7 microns, and with higher pigment loading, such as from about 5 to about 12 percent by weight of toner, such that the mass of toner layers deposited onto paper is reduced to obtain the same quality of image, and resulting in a thinner plastic toner layer onto paper after fusing, thereby minimizing or avoiding paper curling. Toners prepared in accordance with the present invention enable the use of lower fusing temperatures, such as from about 120° to about 150° C., thereby avoiding or minimizing paper curl. Lower fusing temperatures minimize the loss of moisture from paper, thereby reducing or eliminating paper curl. Furthermore, in process color applications and especially in pictorial color applications, toner to paper gloss matching is highly desirable. Gloss matching is referred to as matching the gloss of the toner image to the gloss of the paper. For example, with a low gloss image of preferably from about 1 to about 30 gloss is preferred, low gloss paper is utilized, such as from about 1 to about 30 gloss units as measured by the Gardner Gloss metering unit, and which after image formation with small particle size toners of from about 3 to about 5 microns, and fixing thereafter results in a low gloss toner image of from about 1 to about 30 gloss units as measured by the Gardner Gloss metering unit. Alternatively, if higher image gloss is desired, such as from about above 30 to about 60 gloss units as measured by the Gardner Gloss metering unit, higher gloss paper is utilized, such as from about above 30 to about 60 gloss units, and which after image formation with small particle size toners of the present invention of from about 3 to about 5 microns, and fixing thereafter results in a higher gloss toner image of from about 30 to about 60 gloss units as measured by the Gardner Gloss metering unit. The aforementioned toner to paper matching can be attained with small particle size toners such as less than 7 microns and preferably less than 5 microns, such as from about 1 to about 4 microns such that the pile height of the toner layer(s) is low.

Numerous processes are known for the preparation of toners, such as, for example, conventional processes wherein a resin is melt kneaded or extruded with a pigment, micronized and pulverized to provide toner particles with an average volume particle diameter of from about 9 microns to about 20 microns and with broad geometric size distribution of from about 1.4 to about 1.7. In such processes, it is usually necessary to subject the aforementioned toners to a classification procedure such that a geometric size distribution of from about 1.2 to about 1.4 is attained. Also, in the aforementioned conventional process, low toner yields after classifications may be obtained. Generally, during the preparation of toners with average particle size diameters of from about 11 microns to about 15 microns, toner yields range from about 70 percent to about 85 percent after classification. Additionally, during the preparation of smaller sized toners with particle sizes of from about 7 microns to about 11 microns, lower toner yields are obtained after classification, such as from about 50 percent to about 70 percent. With the processes of the present invention in embodiments, small average particle sizes of from about 3 microns to about 9 microns, and preferably 5 microns are obtained without resorting to classification processes, and wherein narrow geometric size distributions are attained, such as from about 1.16 to about 1.30, and preferably from about 1.16 to about 1.25. High toner yields are also attained such as from about 90 percent to about 98 percent in embodiments. In addition, by the toner particle preparation process of this invention, small particle size toners of from about 3 microns to about 7 microns can be economically prepared in high yields, such as from about 90 percent to about 98 percent by weight based on the weight of all the toner material ingredients.

There is illustrated in U.S. Pat. No. 4,996,127 a toner of associated particles of secondary particles comprising primary particles of a polymer having acidic or basic polar groups and a coloring agent. The polymers selected for the toners of this '127 patent can be prepared by an emulsion polymerization method, see for example columns 4 and 5 of this patent. In column 7 of this '127 patent, it is indicated that the toner can be prepared by mixing the required amount of coloring agent and optional charge additive with an emulsion of the polymer having an acidic or basic polar group obtained by emulsion polymerization. Also, note column 9, lines 50 to 55, wherein a polar monomer, such as acrylic acid, in the emulsion resin is necessary, and toner preparation is not obtained without the use, for example, of acrylic acid polar group, see Comparative Example I. The process of the present invention need not utilize polymers with polar acid groups, and toners can be prepared with resins, such as poly(styrene-butadiene) or PLIOTONE ™, without containing polar acid groups. Additionally, the toner process of the '127 patent does not appear to utilize counterionic surfactant and flocculation. In U.S. Pat. No. 4,983,488, there is illustrated a process for the preparation of toners by the polymerization of a polymerizable monomer dispersed by emulsification in the presence of a colorant and/or a magnetic powder to prepare a principal resin component and then effecting coagulation of the resulting polymerization liquid in such a manner that the particles in the liquid after coagulation have diameters suitable for a toner. It is indicated in column 9 of this patent that coagulated particles of 1 to 100, and particularly 3 to 70, are obtained. This process is thus primarily directed to the use of coagulants, such as inorganic magnesium sulfate which results in the formation of particles with wide GSD. Furthermore, the '488 patent does not appear to disclose the process of counterionic flocculation. Similarly, the aforementioned disadvantages are noted in other prior art, such as U.S. Pat. No. 4,797,339, wherein there is disclosed a process for the preparation of toners by resin emulsion polymerization, wherein similar to the '127 patent polar resins of oppositely charges are selected, and wherein flocculation is not disclosed; and U.S. Pat. No. 4,558,108, wherein there is disclosed a process for the preparation of a copolymer of styrene and butadiene by specific suspension polymerization. Other patents mentioned are U.S. Pat. Nos. 3,674,736; 4,137,188 and 5,066,560.

In U.S. Pat. No. 5,290,654 (D/92277), the disclosure of which is totally incorporated herein by reference, there is disclosed a process for the preparation of toners comprised of dispersing a polymer solution comprised of an organic solvent, and a polyester and homogenizing and heating the mixture to remove the solvent and thereby form toner composites. Additionally, there is disclosed in U.S. Pat. No. 5,278,020 (D/92097), the disclosure of which is totally incorporated herein by reference, a process for the preparation of in situ toners comprising an halogenization procedure which, for example, chlorinates the outer surface of the toner and results in enhanced blocking properties.

In U.S. Pat. No. 5,308,734 (D/92576), the disclosure of which is totally incorporated herein by reference, there is illustrated a process for the preparation of toner compositions which comprises generating an aqueous dispersion of toner fines, ionic surfactant and nonionic surfactant, adding thereto a counterionic surfactant with a polarity opposite to that of said ionic surfactant, homogenizing and stirring said mixture, and heating to provide for coalescence of said toner fine particles.

In copending patent application U.S. Ser. No. 022,575 (D/92577), the disclosure of which is totally incorporated herein by reference there is disclosed a process for the preparation of toner compositions comprising (i) preparing a pigment dispersion in a water, which dispersion is comprised of a pigment, an ionic surfactant, and optionally a charge control agent;

(ii) shearing the pigment dispersion with a latex mixture comprised of a counterionic surfactant with a charge polarity of opposite sign to that of said ionic surfactant, a nonionic surfactant and resin particles, thereby causing a flocculation or heterocoagulation of the formed particles of pigment, resin and charge control agent to form electrostatically bounded toner size aggregates; and (iii) heating the statically bound aggregated particles to form said toner composition comprised of polymeric resin, pigment and optionally a charge control agent.

Disadvantages associated with some of the above processes, which disadvantages are avoided or minimized with the processes of the present invention, include preventing further growth in the size of the particles formed in the aggregation step during the heating of particles above their resin Tg, which is required to form stable toner composite particles. An advantage with the present process is that by the addition of extra surfactant as indicated herein one is able to retain the particle size distribution achieved in the aggregation step during the heating of particles above their resin Tg, which is needed to form stable toner composite particles. The primary advantage of accomplishing this is that one is able to control "by freezing" on to any given particle size and distribution, thus retaining these properties during the coalescence stage whereby the toner composites comprising resin pigment and optionally charge control agents are formed. Also, with the process of the present invention the stirring speed decrease enables controlled particle size and minimal further aggregation growth in (iv). This can increase the process latitude in controlling the particle size and particle size distribution.

In copending patent application U.S. Ser. No. 082,651 (D/93105), filed concurrently herewith, the disclosure of which is totally incorporated herein by reference, there is illustrated a process for the preparation of toner compositions with controlled particle size comprising:

(i) preparing a pigment dispersion in water, which dispersion is comprised of pigment, an ionic surfactant and an optional charge control agent;

(ii) shearing at high speeds the pigment dispersion with a polymeric latex comprised of resin, a counterionic surfactant with a charge polarity of opposite sign to that of said ionic surfactant, and a nonionic surfactant thereby forming a uniform homogeneous blend dispersion comprised of resin, pigment, and optional charge agent;

(iii) heating the above sheared homogeneous blend below about the glass transition temperature (Tg) of the resin while continuously stirring to form electrostatically bound toner size aggregates with a narrow particle size distribution;

(iv) heating the statically bound aggregated particles above about the Tg of the resin particles to provide coalesced toner comprised of resin, pigment and optional charge control agent, and subsequently optionally accomplishing (v) and (vi);

(v) separating said toner; and (vi) drying said toner.

In copending patent application U.S. Ser. No. 083,146 (D/93106), filed concurrently herewith, the disclosure of which is totally incorporated herein by reference, there is illustrated a process for the preparation of toner compositions with a volume median particle size of from about 1 to about 25 microns, which process comprises:

(i) preparing by emulsion polymerization an anionic charged polymeric latex of submicron particle size, and comprised of resin particles and anionic surfactant;

(ii) preparing a dispersion in water, which dispersion is comprised of optional pigment, an effective amount of cationic flocculant surfactant, and optionally a charge control agent;

(iii) shearing the dispersion (ii) with said polymeric latex thereby causing a flocculation or heterocoagulation of the formed particles of optional pigment, resin and charge control agent to form a high viscosity gel in which solid particles are uniformly dispersed;

(iv) stirring the above gel comprised of latex particles, and oppositely charged dispersion particles for an effective period of time to form electrostatically bound relatively stable toner size aggregates with narrow particle size distribution; and (v) heating the electrostatically bound aggregated particles at a temperature above the resin glass transition temperature (Tg) thereby providing said toner composition comprised of resin, optional pigment and optional charge control agent.

In copending patent application U.S. Ser. No. 082,741 (D/93108), filed concurrently herewith, the disclosure of which is totally incorporated herein by reference, there is illustrated a process for the preparation of toner compositions with controlled particle size and selected morphology comprising (i) preparing a pigment dispersion in water, which dispersion is comprised of pigment, ionic surfactant, and optionally a charge control agent;

(ii) shearing the pigment dispersion with a polymeric latex comprised of resin of submicron size, a counterionic surfactant with a charge polarity of opposite sign to that of said ionic surfactant and a nonionic surfactant thereby causing a flocculation or heterocoagulation of the formed particles of pigment, resin and charge control agent, and generating a uniform blend dispersion of solids of resin, pigment, and optional charge control agent in the water and surfactants;

(iii) (a) continuously stirring and heating the above sheared blend to form electrostatically bound toner size aggregates; or (iii)(b) further shearing the above blend to form electrostatically bound well packed aggregates; or (iii) (c) continuously shearing the above blend, while heating to form aggregated flake-like particles;

(iv) heating the above formed aggregated particles about above the Tg of the resin to provide coalesced particles of toner; and optionally (v) separating said toner particles from water and surfactants; and (vi) drying said toner particles.

In copending patent application U.S. Ser. No. 082,660 (D/93110), filed concurrently herewith, the disclosure of which is totally incorporated herein by reference, there is illustrated a process for the preparation of toner compositions comprising:

(i) preparing a pigment dispersion, which dispersion is comprised of a pigment, an ionic surfactant, and optionally a charge control agent;

(ii) shearing said pigment dispersion with a latex or emulsion blend comprised of resin, a counterionic surfactant with a charge polarity of opposite sign to that of said ionic surfactant and a nonionic surfactant;

(iii) heating the above sheared blend below about the glass transition temperature (Tg) of the resin to form electrostatically bound toner size aggregates with a narrow particle size distribution; and (iv) heating said bound aggregates above about the Tg of the resin.

In copending patent application U.S. Ser. No. 083,116 (D/93111), filed concurrently herewith, the disclosure of which is totally incorporated herein by reference, there is illustrated a process for the preparation of toner compositions comprising (i) preparing a pigment dispersion in water, which dispersion is comprised of pigment, a counterionic surfactant with a charge polarity of opposite sign to the anionic surfactant of (ii) and optionally a charge control agent;

(ii) shearing the pigment dispersion with a latex comprised of resin, anionic surfactant, nonionic surfactant, and water; and wherein the latex solids content, which solids are comprised of resin, is from about 50 weight percent to about 20 weight percent thereby causing a flocculation or heterocoagulation of the formed particles of pigment, resin and optional charge control agent; diluting with water to form a dispersion of total solids of from about 30 weight percent to 1 weight percent, which total solids are comprised of resin, pigment and optional charge control agent contained in a mixture of said nonionic, anionic and cationic surfactants;

(iii) heating the above sheared blend at a temperature of from about 5° to about 25° C. below about the glass transition temperature (Tg) of the resin while continuously stirring to form toner sized aggregates with a narrow size dispersity; and (iv) heating the electrostatically bound aggregated particles at a temperature of from about 5° to about 50° C. above about the Tg of the resin to provide a toner composition comprised of resin, pigment and optionally a charge control agent.

SUMMARY OF THE INVENTION

It is an object of the present invention to provide toner processes with many of the advantages illustrated herein.

In another object of the present invention there are provided simple and economical processes for the direct preparation of black and colored toner compositions with, for example, excellent pigment dispersion and narrow GSD.

In another object of the present invention there are provided simple and economical in situ processes for black and colored toner compositions by an aggregation process comprised of (i) preparing a cationic pigment mixture containing pigment particles, and optional charge control agents, and other known optional additives dispersed in water containing a cationic surfactant by shearing, microfluidizing or ultrasonifying; (ii) shearing the pigment mixture with a charged, positively or negatively, latex mixture comprised of a polymer resin, anionic surfactant and nonionic surfactant thereby causing a flocculation or heterocoagulation; (iii) stirring with optional heating at about 5° C. to 25° C. below the resin Tg, which resin Tg is in the range of about 45° C. to about 90° C. and preferably between 50° C. and 80° C., allows the formation of electrostatically stable aggregates of from about 0.5 to about 5 microns in volume diameter as measured by the Coulter Counter; (iv) reducing the stirring speed and then adding additional anionic or nonionic surfactant into aggregates to increase their stability and to retain particle size and particle size distribution during the heating stage; and (v) coalescing or fusing the aggregate particle mixture by heat to toner composites, or a toner composition comprised of resin, pigment, and charge additive.

In a further object of the present invention there is provided a process for the preparation of toner with an average particle diameter of from between about 1 to about 50 microns, and preferably from about 1 to about 7 microns, and with a narrow GSD of from about 1.2 to about 1.3 and preferably from about 1.16 to about 1.25 as measured by the Coulter Counter.

Moreover, in a further object of the present invention there is provided a process for the preparation of toners which after fixing to paper substrates results in images with gloss of from 20 GGU up to 70 GGU as measured by Gardner Gloss meter matching of toner and paper.

In another object of the present invention there are provided composite polar or nonpolar toner compositions in high yields of from about 90 percent to about 100 percent by weight of toner without resorting to classification.

In yet another object of the present invention there are provided toner compositions with low fusing temperatures of from about 110° C. to about 150° C. and with excellent blocking characteristics at from about 50° C. to about 60° C.

Moreover, in another object of the present invention there are provided toner compositions with a high projection efficiency such as from about 75 to about 95 percent efficiency as measured by the Match Scan II spectrophotometer available from Milton-Roy.

In a further object of the present invention there are provided toner compositions which result in low or no paper curl.

Another object of the present invention resides in processes for the preparation of small sized toner particles with narrow GSDs, and excellent pigment dispersion by the aggregation of latex particles with pigment particles dispersed in water and surfactant, and wherein the aggregated particles, of toner size, can then be caused to coalesce by, for example, heating. In embodiments, factors of importance with respect to controlling particle size and GSD include the concentration of the surfactant in the latex, concentration of the counterionic surfactant used for flocculation, the temperature of aggregation, the solids, which solids are comprised of resin, pigment, and optional toner additives content, reduction in stirring speeds, the time, and the amount of the surfactant used for "freezing" the particle size, for example an aggregation of a cyan pigmented toner particle was performed at a temperature of 45° C. for 2.5 hours while being stirred at 650 rpm. The stirring speed can be reduced from 650 to 250 rpm, and then 45 milliliters of 20 percent anionic surfactant can be added, and the kettle temperature raised to 85° C. and held there for 4 hours to coalesce the aggregates to form the toner composite comprised of resin, pigment and optional charge additive. A toner particle size of 4.7 microns and GSD of 1.20, for example, were obtained.

These and other objects of the present invention are accomplished in embodiments by the provision of toners and processes thereof. In embodiments of the present invention, there are provided processes for the economical direct preparation of toner compositions by an improved flocculation or heterocoagulation, and coalescence processes, and wherein the stirring speeds and the amount of cationic surfactant selected can be utilized to control the final toner particle size, that is average volume diameter.

In embodiments, the present invention is directed to processes for the preparation of toner compositions which comprises initially attaining or generating an ionic pigment dispersion, for example dispersing an aqueous mixture of a pigment or pigments, such as phthalocyanine, quinacridone or RHODAMINE B™ type, with a cationic surfactant, such as benzalkonium chloride, by utilizing a high shearing device, such as a Brinkmann Polytron; thereafter shearing this mixture by utilizing a high shearing device, such as a Brinkmann Polytron, or sonicator or microfluidizer, with a suspended resin mixture comprised of polymer particles, such as poly(styrene butadiene) or poly(styrene butylacrylate), and of particle size ranging from 0.01 to about 0.5 micron in an aqueous surfactant mixture containing an anionic surfactant, such as sodium dodecylbenzene sulfonate and nonionic surfactant, resulting in a flocculation, or heterocoagulation of the resin particles with the pigment particles caused by the neutralization of anionic surfactant absorbed on the resin particles with the oppositely charged cationic surfactant absorbed on the pigment particle; and further stirring the mixture using a mechanical stirrer at 300 to 800 rpm with optional heating, from about 25° C. to about 5° C. below the resin Tg, and allowing the formation of electrostatically stabilized aggregates ranging from about 0.5 micron to about 10 microns; followed by addition of anionic or nonionic surfactant to "freeze" the size of those aggregates and heating from about 60° C. to about 95° C. to provide for particle fusion or coalescence of the polymer and pigment particles; followed by washing with, for example, hot water to remove surfactant, and drying, such as by use of an Aeromatic fluid bed dryer, a freeze dryer, or spray dryer; whereby toner particles comprised of resin and pigment with various particle size diameters can be obtained, such as from about 1 to about 10 microns in average volume particle diameter as measured by the Coulter Counter.

Embodiments of the present invention include a process for the preparation of toner compositions comprising (i) preparing a pigment dispersion in a water, which dispersion is comprised of a pigment, an ionic surfactant and optionally a charge control agent;

(ii) shearing the pigment dispersion with a positively or negatively charged latex mixture comprised of a counterionic surfactant with a charge polarity of opposite sign to that of said ionic surfactant, a nonionic surfactant and resin particles;

(iii) stirring in the range of from about 300 to about 800 rpm for 1 to 4 hours the homogenized mixture with optional heating at a temperature of from about 25° C. to about 50° C. and from about 5° C. to about 25° C. below the resin Tg, which Tg is between about 45° C. to 90° C. and preferably between about 50° C. to 80° C., thereby causing a flocculation or heterocoagulation of the formed particles of pigment, resin and charge control agent to form electrostatically bound toner size aggregates;

(iv) reducing the stirring speed from 300 to 800 to 200 to about 600 rpm, and then stabilizing the aggregates by the addition of extra 0.01 to 10 percent of the total kettle volume of anionic or nonionic surfactant prior to heating above the resin Tg; and (v) heating to from about 60° C. to about 95° C. the statically bound aggregated particles above, for example 5° C. to about 50° C., with the resin Tg being in range of between 45° C. about 90° C. and preferably between 50° C. and about 80° C., to form said toner composition comprised of polymeric resin, pigment, and optionally a charge control agent.

In one embodiment in the present invention, there is provided a process for the preparation of toner compositions with controlled particle size comprising:

(i) preparing a positively charged pigment dispersion in water, which the dispersion is comprised of a pigment, an ionic surfactant in amounts of from about 0.5 to about 10 percent by weight of water and an optional charge control agent;

(ii) shearing the pigment dispersion with a latex mixture comprised of a counterionic surfactant with a charge polarity of opposite sign to that of said ionic surfactant, a nonionic surfactant and resin particles, thereby causing a flocculation or heterocoagulation of the formed particles of pigment, resin, and charge control agent;

(iii) stirring the resulting sheared viscous mixture of (ii) at from about 300 to about 1,000 revolutions per minute to form electrostatically bound substantially stable, for Coulter Counter measurements, toner size aggregates with a narrow particle size distribution;

(iv) reducing the stirring speed to from about 200 to about 600 revolutions per minute and subsequently optionally adding further anionic or nonionic surfactant in the range of from about 0.1 to about 10 percent by weight of water to control, prevent, or minimize further growth or enlargement of the particles in the coalescence step (iii); and (v) heating and coalescing, from about 5° C. to about 50° C. above the resin Tg, which resin Tg is from between about 45° C. to about 90° C. and preferably from between about 50° C. and about 80° C., the statically bound aggregated particles to form said toner composition comprised of resin, pigment, and optional charge control agent.

Also, in embodiments the present invention is directed to processes for the preparation of toner compositions which comprises (i) preparing an ionic pigment mixture by dispersing a pigment, such as carbon black like REGAL 330®, HOSTAPERM PINK™, or PV FAST BLUE™, of from about 2 to about 10 percent by weight of toner in an aqueous mixture containing a cationic surfactant, such as dialkylbenzene dialkylammonium chloride like SANIZOL B-50™ available from Kao or MIRAPOL™ available from Alkaril Chemicals, of from about 0.5 to about 2 percent by weight of water, utilizing a high shearing device, such as a Brinkmann Polytron or IKA homogenizer at a speed of from about 3,000 revolutions per minute to about 10,000 revolutions per minute for a duration of from about 1 minute to about 120 minutes; (ii) adding the aforementioned ionic pigment mixture to an aqueous suspension of resin particles comprised of, for example, poly(styrene-butylmethacrylate), PLIOTONE™ or poly(styrene-butadiene) of from about 88 percent to about 98 percent by weight of the toner, and of about 0.1 micron to about 3 microns polymer particle size in volume average diameter, and counterionic surfactant, such as an anionic surfactant, such as sodium dodecyl sulfate, dodecylbenzene sulfonate or NEOGEN R™, from about 0.5 to about 2 percent by weight of water, a nonionic surfactant, such polyethylene glycol or polyoxyethylene glycol nonyl phenyl ether or IGEPAL 897™ obtained from GAF Chemical Company, of from about 0.5 to about 3 percent by weight of water, thereby causing a flocculation or heterocoagulation of pigment, charge control additive and resin particles; (iii) homogenizing the resulting flocculent mixture with a high shearing device, such as a Brinkmann Polytron or IKA homogenizer, at a speed of from about 3,000 revolutions per minute to about 10,000 revolutions per minute for a duration of from about 1 minute to about 120 minutes, thereby resulting in a homogeneous mixture of latex and pigment; and stirring with a mechanical stirrer from about 300 to about 800 rpm with heating to 5° C. to 25° C. below the resin Tg, where the resin Tg is preferably 54° C., for 1 to 24 hours to form electrostatically stable aggregates of from about 0.5 micron to about 5 microns in average volume diameter; (iv) adding extra anionic surfactant or nonionic surfactant in the amount of from 0.5 percent to 5 percent by weight of the water to stabilize aggregates formed in the previous step; (v) heating the statically bound aggregate composite particles at from about 60° C. to about 95° C., for example from about 5° C. to about 50° C. above the resin Tg, which is preferably 54° C., and for a duration of about 60 minutes to about 600 minutes to form toner sized particles of from about 3 microns to about 7 microns in volume average diameter and with a geometric size distribution of from about 1.2 to about 1.3 as measured by the Coulter Counter; and (vi) isolating the toner sized particles by washing, filtering and drying thereby providing a composite toner composition. Additives to improve flow characteristics, and charge additives to improve charging characteristics may then optionally be added by blending with the toner such additives including AEROSI LS® or silicas, metal oxides like tin, titanium and the like of from about 0.1 to about 10 percent by weight of the toner.

One preferred method of obtaining a pigment dispersion can depend on the form of the pigment utilized. In some instances, pigments are available in the wet cake or concentrated form containing water, and thus they can be easily dispersed utilizing an homogenizer or stirring. In other instances, pigments are available in a dry form, whereby dispersion in water is effected by microfluidizing using, for example, a M-110 microfluidizer and passing the pigment dispersion from 1 to 10 times through the fluidizer chamber, or by sonication, such as using a Branson 700 sonicator, with the optional addition of dispersing agents such as the aforementioned ionic or nonionic surfactants.

Illustrative examples of resin particles selected for the process of the present invention include known polymers such as poly(styrene-butadiene), poly(para-methyl styrene-butadiene), poly(meta-methyl styrene-butadiene), poly(alpha-methyl styrene-butadiene), poly(methylmethacrylate-butadiene), poly(ethylmethacrylate-butadiene), poly(propylmethacrylate-butadiene), poly(butylmethacrylate-butadiene), poly(methylacrylate-butadiene), poly(ethylacrylate-butadiene), poly(propylacrylate-butadiene), poly(butylacrylate-butadiene), poly(styrene-isoprene), poly(para-methyl styrene-isoprene), poly(metamethyl styrene-isoprene), poly(alpha-methylstyrene-isoprene), poly(methylmethacrylate-isoprene), poly(ethylmethacrylate-isoprene), poly(propylmethacrylate-isoprene), poly(butylmethacrylate-isoprene), poly(methylacrylate-isoprene), poly(ethylacrylate-isoprene), poly(propylacrylate-isoprene), and poly(butylacrylate-isoprene), terpolymers such as poly(styrene-butadiene-acrylic acid), poly(styrene-butadiene-methacrylic acid), PLIOTONE™ available from Goodyear, polyethylene-terephthalate, polypropylene-terephthalate, polybutylene-terephthalate, polypentylene-terephthalate, polyhexalene-terephthalate, polyheptadene-terephthalate, polyoctalene-terephthalate, POLYLITE™ (Reichhold Chemical Inc), PLASTHALL™ (Rohm & Hass), CYGAL™ (American Cyanamide), ARMCO™ (Armco Composites), CELANEX™ (Celanese Eng), RYNITE™ (DuPont), STYPOL™, and the like. The resin selected generally can be in embodiments styrene acrylates, styrene butadienes, styrene methacrylates, or polyesters, are present in various effective amounts, such as from about 85 weight percent to about 98 weight percent of the toner, and can be of small average particle size such as from about 0.01 micron to about 1 micron in average volume diameter as measured by the Brookhaven nanosize particle analyzer.

The resin selected for the process of the present invention can be prepared by emulsion polymerization techniques, and the monomers utilized in such processes can be styrene, acrylates, methacrylates, butadiene, isoprene, and optionally acid or basic olefinic monomers, such as acrylic acid, methacrylic acid, acrylamide, methacrylamide, quaternary ammonium halide of dialkyl or trialkyl acrylamides or methacrylamide, vinylpyridine, vinylpyrrolidone, vinyl-N-methylpyridinium chloride, and the like. The presence of acid or basic groups is optional and such groups can be present in various amounts of from about 0.1 to about 10 percent by weight of the polymer resin. Known chain transfer agents, such as dodecanethiol or carbon tetrabromide, can also be selected when preparing resin particles by emulsion polymerization. Other processes for obtaining resin particles of from about 0.01 micron to about 3 microns can be selected from polymer microsuspension process, such as disclosed in U.S. Pat. No. 3,674,736, the disclosure of which is totally incorporated herein by reference, and polymer solution microsuspension process, such as disclosed in U.S. Pat. No. 5,290,654 (D/92277), the disclosure of which is totally incorporated herein by reference. Mechanical grinding process, and other known processes can also be selected, or the resin can be purchased.

Various known colorants or pigments present in the toner in an effective amount of, for example, from about 1 to about 25 percent by weight of the toner, and preferably in an amount of from about 1 to about 15 weight percent that can be selected include carbon black like REGAL 330®, REGAL 330R®, REGAL 660®, REGAL 660R®, REGAL 400®, REGAL 400R®, and other equivalent black pigments. As colored pigments, there can be selected known cyan, magenta, blue, red, green, brown, yellow, or mixtures thereof. Specific examples of pigments include phthalocyanine HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E. D. TOLUIDINE RED™ and BON RED C™ available from Dominion Color Corporation, Ltd., Toronto, Ontario, NOVAperm YELLOW FGL™, HOSTAPERM PINK E™ from Hoechst, and CINQUASIA MAGENTA™ available from E.I. DuPont de Nemours & Company, and the like. Generally, colored pigments that can be selected are cyan, magenta, or yellow pigments. Examples of magenta materials that may be selected as pigments include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyan materials that may be used as pigments include copper tetra(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative examples of yellow pigments that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro2,5-dimethoxy acetoacetanilide, and Permanent Yellow FGL. The pigments or dyes selected are present in various effective amounts, such as from about 1 weight percent to about 65 weight and preferably from about 2 to about 12 percent of the toner.

The toner may also include known charge additives in effective amounts of, for example, from 0.1 to 5 weight percent such as alkyl pyridinium halides, bisulfates, the charge control additives of U.S. Pat. Nos. 3,944,493; 4,007,293; 4,079,014; 4,394,430 and 4,560,635, which illustrates a toner with a distearyl dimethyl ammonium methyl sulfate charge additive, the disclosures of which are totally incorporated herein by reference, negative charge additives like aluminum complexes, and the like.

Surfactants in amounts of, for example, 0.1 to about 25 weight percent in embodiments include, for example, nonionic surfactants such as dialkyphenoxypoly(ethyleneoxy) ethanol such as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™, ANTAROX 897™, and the like. An effective concentration of the nonionic surfactant is, for example, from about 0.01 to about 10 percent by weight, and preferably from about 0.1 to about 5 percent by weight of monomers used to prepare the copolymer resin.

Examples of ionic include anionic and cationic, and examples of anionic include surfactants selected for the preparation of toners and the processes of the present invention are, for example, sodium dodecyl sulfate (SDS), sodium dodecylbenzene sulfonate, sodium dodecylnaphthalene sulfate, dialkyl benzenealkyl, sulfates and sulfonates, abitic acid available from Aldrich, NEOGEN R™, NEOGEN SC™ available from Kao, and the like. An effective concentration of the anionic surfactant generally employed is, for example, from about 0.01 to about 10 percent by weight, and preferably from about 0.1 to about 5 percent by weight.

Examples of the cationic surfactants selected for the toners and processes of the present invention are, for example, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™ available from Alkaril Chemical Company, SANIZOL™ (benzalkonium chloride), available from Kao Chemicals, and the like, and mixtures thereof. This surfactant is utilized in various effective amounts, such as for example from about 0.1 percent to about 5 percent by weight of water. Preferably the molar ratio of the cationic surfactant used for flocculation to the anionic surfactant used in the latex preparation is in the range of about 0.5 to 4, and preferably from about 0.5 to 2.

Examples of the surfactant which are added to the aggregated particles to "freeze" or retain particle size, and GSD achieved in the aggregation can be selected from the anionic surfactants, such as sodium dodecylbenzene sulfonate, sodium dodecylnaphthalene sulfate, dialkyl benzenealkyl, sulfates and sulfonates available from Aldrich, NEOGEN R™ NEOGEN SC™ from Kao, and the like. These surfactants also include nonionic surfactants such as polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol (available from Rhone-Poulenac as IGEPAL CA-210™, IGEPAL CA-520™, IGEPAL CA-720™, IGEPAL CO-890[198], IGEPAL CO-720™, IGEPAL CO-290™, IGEPAL CA-210™, ANTAROX 890™ and ANTAROX 897™.

An effective concentration of the anionic or nonionic surfactant generally employed in embodiments as a "freezing agent" or stabilizing agent is, for example, from about 0.01 to about 30 percent by weight, and preferably from about 0.5 to about 5 percent by weight of the total weight of the aggregated mixture.

Surface additives that can be added to the toner compositions after washing or drying include, for example, metal salts, metal salts of fatty acids, colloidal silicas, mixtures thereof, and the like, which additives are usually present in an amount of from about 0.1 to about 2 weight percent, reference U.S. Pat. Nos. 3,590,000; 3,720,617; 3,655,374 and 3,983,045, the disclosures of which are totally incorporated herein by reference. Preferred additives include zinc stearate and AEROSIL R972® available from Degussa in amounts of from 0.1 to 2 percent, which can be added, for example, during the aggregation process or blended into the formed toner product.

Stirring speeds in (iii) are from about 300 to about 1,000 rpm, and this speed is reduced in (iv) as illustrated herein.

Developer compositions can be prepared by mixing the toners obtained with the processes of the present invention with known carrier particles, including coated carriers, such as steel, ferrites, and the like, reference U.S. Pat. Nos. 4,937,166 and 4,935,326, the disclosures of which are totally incorporated herein by reference, for example from about 2 percent toner concentration to about 8 percent toner concentration. Latent images can then be developed with the aforementioned toner, reference for example U.S. Pat. No. 4,265,690, the disclosure of which is totally incorporated herein by reference.

The following Examples are being submitted to further define various species of the present invention. These Examples are intended to be illustrative only and are not intended to limit the scope of the present invention. Also, parts and percentages are by weight unless otherwise indicated.

EXAMPLE 1

Pigment dispersion: 280 grams (grams) of dry pigment PV FAST BLUE™ and 58.5 grams of cationic surfactant alkylbenzyldimethyl ammonium chloride (SANIZOL B-50™) were dispersed in 8,000 grams of deionized water using a microfluidizer.

A polymeric latex was prepared by emulsion polymerization of styrene/butylacrylate/acrylic acid, 82/18/2 parts (by weight) in nonionic/anionic surfactant solution (3 percent) as follows. 352 Grams of styrene, 48 grams of butylacrylate, 8 grams of acrylic acid, and 12 grams of dodecanethiol were mixed with 600 milliliters of deionized water in which 9 grams of sodium dodecyl benzene sulfonate anionic surfactant (NEOGEN R™ which contains 60 percent of active component), 8.6 grams of polyoxyethylene nonyl phenyl ether—nonionic surfactant (ANTAROX 897™—70 percent active), and 4 grams of ammonium persulfate initiator were dissolved. The emulsion was then polymerized at 70° C. for 8 hours. The resulting latex contained 60 percent of water and 40 percent of solids of the styrene polymer 82/18/2; the Tg of the latex dry sample was 53.1° C., as measured on DuPont DSC; $M_w$=46,000, and $M_n$=7,700 as determined on Hewlett Packard GPC. The zeta potential as measured on Pen Kem Inc. Laser Zee Meter was −80 millivolts. The particle size of the latex as measured on Brookhaven BI-90 Particle Nanosizer was 147 nanometers. The aforementioned latex was then selected for the toner preparation of Example I and Comparative Example IA.

PREPARATION OF TONER SIZE PARTICLES:

Preparation of the aggregated particles: 540 grams of the PV FAST BLUE™ dispersion were added simultaneously with 850 grams of the above prepared latex into a SD41 continuous stirring device (Janke & Kunkel IKA Labortechnik) containing 780 milliliters of water with 3.83 grams of the cationic surfactant alkylbenzyldimethyl ammonium chloride (SANIZOL B-50™). The pigment dispersion and the latex were well mixed by continuous pumping through the shearing chamber operating at 10,000 rpm for 8 minutes. 430 Milliliters of this blend was then transferred into a kettle placed in the heating mantle and equipped with mechanical stirrer operating at 400 rpm and temperature probe. The temperature of the mixture was raised from room temperature to 35° C. and the aggregation was performed for 17 hours at 35° C. Aggregates with a particle size of 4.4 (GSD=1.21), as measured on the Coulter Counter, were obtained.

Coalescence of aggregated particles: The temperature of the aggregated particles in the kettle was then raised to 80° C. at 1°/minute. When it reached temperature of 40° C., the stirring speed was reduced from 400 to 150 rpm and 200 milliliters of 4 percent solution of anionic surfactant (NEOGEN R™) were added while stirring. The particle size was measured on the Coulter Counter to be 4.5 microns with a GSD=1.23. The heating was continued at 80° C. for 3 hours to coalesce the aggregated particles. Samples were taken at different stages of the heating process and their size was measured. No change in the particle size and a GSD was observed. After 1 hour of heating at 80° C., the particle size was about 4.5 microns with a GSD of 1.24; after 3 hours of heating, the particle size was 4.6 microns with a GSD of 1.24. Also, the aggregated particles were coalesced after 3 hours of heating. As a severe test for their stability—sonication of the dispersion of particles in water for 60 seconds was performed. This test showed no change in particle size and the GSD after sonication. The particle size of the sonicated sample was 4.4 microns with a GSD of 1.23, indicating mechanical stability of the coalesced particles.

The resulting toner was comprised of 95 percent of polystyrene (82 parts), polybutylacrylate (18 parts) and polyacrylic acid (2 parts) and cyan pigment, 5 percent by weight of toner, with an average volume diameter of 4.6 microns and a GSD of 1.24, indicating that by adding an extra amount of anionic surfactant prior to increasing the kettle temperature above the resin Tg to accomplish the coalescence, and reducing the stirring speed, one can retain particle size and GSD achieved in the aggregation step during coalescence. The toner particles were then washed by filtration using hot water (50° C.) and dried on the freeze dryer. The yield of dry toner particles was 98 percent.

Washing by filtration with hot water and drying with a freeze dryer was utilized in all the Examples unless otherwise indicated.

COMPARATIVE EXAMPLE IA

No Extra Anionic Surfactant

Pigment dispersion: 280 Grams of dry pigment PV FAST BLUE™ and 58.5 grams of cationic surfactant alkylbenzyldimethyl ammonium chloride (SANIZOL B-50™) were dispersed in 8,000 grams of deionized water using a microfluidizer.

A polymeric latex was prepared by emulsion polymerization of styrene/butylacrylate/acrylic acid (82/18/2 parts) in a nonionic/anionic surfactant solution (3 percent) as follows. 352 Grams of styrene, 48 grams of butylacrylate, 8 grams of acrylic acid, and 12 grams of dodecanethiol were mixed with 600 milliliters of deionized water in which 9 grams of sodium dodecyl benzene sulfonate anionic surfactant (NEOGEN R™ which contains 60 percent of active component), 8.6 grams of polyoxyethylene nonyl phenyl ether—nonionic surfactant (ANTAROX 897™—70 percent active), and 4 grams of ammonium persulfate initiator were dissolved. The emulsion was then polymerized at 70° C. for 8 hours. The resulting latex contained 40 percent of solids; the Tg of the latex dry sample was 53.1 ° C., as measured on DuPont DSC; $M_w$=46,000, and $M_n$=7,700 as determined on Hewlett Packard GPC. The zeta potential as measured on Pen Kem Inc. Laser Zee Meter was −80 millivolts. The particle size of the latex as measured on Brookhaven BI-90 Particle Nanosizer was 147 nanometers. The aforementioned latex was then selected for the toner preparation of Example IA.

PREPARATION OF TONER SIZE PARTICLES:

Preparation of the aggregated particles: 540 grams of the PV FAST BLUE™ dispersion were added simultaneously with 850 grams of latex into the SD41 continuous stirring device (Janke & Kunkel IKA Labortechnik) containing 780 milliliters of water with 3.83 grams of cationic surfactant alkylbenzyldimethyl ammonium chloride (SANIZOL B-50™). The pigment dispersion and the latex were well mixed by continuous pumping through the shearing chamber operating at 10,000 rpm for 8 minutes. 430 Milliliters of this blend were then transferred into the kettle placed in the heating mantle and equipped with mechanical stirrer and temperature probe. The temperature of the mixture was raised to 35° C. and the aggregation was performed for 17 hours at 35° C. while being stirred at 400 rpm. Aggregates with a particle size of 4.4 (GSD=1.21), as measured on the Coulter Counter, were obtained.

Coalescence of aggregated particles: the temperature of the aggregated particles in the kettle was raised to 80° C. at 1°/minute. No additional anionic surfactant was added prior to heating, and the stirring speed of 400 rpm was not reduced. The heating was continued at 80° C. for 3 hours to coalesce the aggregated particles. The size of the coalesced particles was measured on the Coulter Counter. Particles of 7.6 microns (average volume diameter) with a GSD of 1.20 were observed, indicating that further growth of the aggregated particles occurred during heating stage as the stability of the aggregated system was not increased.

The toner particles were then washed by filtration using hot water (50° C.) and dried on the freeze dryer. The yield of dry toner particles was 99 percent. The resulting toner particles were comprised of 95 percent of styrene (82 parts), butylacrylate (18 parts) and acrylic acid (2 parts) and cyan pigment, 5 percent by weight of toner, with an average volume diameter of about 7.6 microns and a GSD of about 1.20, indicating that without addition of extra anionic surfactant prior to increasing the kettle temperature above the resin Tg, and without decreasing the stirring speed, the particle size and GSD achieved in the aggregation step were not retained during coalescence.

EXAMPLE II

Pigment dispersion: 26.3 grams of wet cake of pigment SUN FAST BLUE™ and 2.92 grams of cationic surfactant alkylbenzyldimethyl ammonium chloride (SANIZOL B-50™) were dispersed in 400 grams of water using a homogenizer.

A polymeric latex was prepared by emulsion polymerization of styrene/butylacrylate/acrylic acid (82/18/2 parts)in nonionic/anionic surfactant solution (3 percent) using ammonium persulfate as an initiator and dodecanethiol as a chain transfer agent. The emulsion was then polymerized at 70° C. for 8 hours. The resulting latex contained 40 percent of solids; the Tg of the latex dry sample was 53.0° C., as measured on DuPont DSC; $M_w$=24,000 and $M_n$=2,000 as determined on Hewlett Packard GPC. The zeta potential as measured on Pen Kem Inc. Laser Zee Meter was −85 millivolts. The particle size of the latex measured on Brookhaven Particle Nanosizer BI-90 was 151 nanometers.

PREPARATION OF TONER SIZE PARTICLES:

Preparation of the aggregated particles: 429.2 grams of the Sun FAST BLUE™ dispersion were added simultaneously with 650 grams of the above latex into a SD41 continuous stirring device (Janke & Kunkel IKA Labortechnik) containing 600 milliliters of water with 2.9 grams of cationic surfactant alkylbenzyldimethyl ammonium chloride (SANIZOL B-50™). The pigment dispersion and the latex were well mixed by continuous pumping through the shearing chamber operating at 10,000 rpm for 8 minutes. This blend was than transferred into the kettle placed in the heating mantle and equipped with mechanical stirrer and temperature probe. The aggregation was performed at 45° C. for 90 minutes, while stirring at 650 rpm. Aggregates with the particle size of 4.6 with the GSD of 1.18, as measured on the Coulter Counter, were obtained.

Coalescence of aggregated particles: after aggregation, the stirring speed was reduced from 650 to 250 rpm and 60 milliliters of 20 percent by weight of anionic surfactant (NEOGEN R™) in water were added, and then the temperature was raised to 80° C. Aggregates of latex and pigment particles were coalesced at 80° C. for 3 hours. After 3 hours of heating, particles of 4.6 microns with 1.18 GSD were measured on the Coulter Counter. These results indicated that no additional growth resulted, that is the toner remained at 4.6 microns with a GSD of 1.18 of the particles occurred during the heating of aggregates at 80° C. This is caused primarily by the addition of extra anionic surfactant prior to increasing the kettle temperature above the resin Tg to accomplish coalescence enabling increased colloidal stability, and reducing the stirring speed.

The toner was washed by filtration using hot water (50° C.) and dried on the freeze dryer. The resulting toner particles comprised of 95 percent of styrene (82 parts), butyl acrylate (18 parts) and acrylic acid (2 parts), and cyan pigment (5 percent by weight of toner). The yield of dry toner particles was 98 percent.

EXAMPLE II

Pigment dispersion: 30 grams of the wet cake pigment SUN FAST YELLOW™ and 2.9 grams of cationic surfactant alkylbenzyldimethyl ammonium chloride (SANIZOL B-50™) were dispersed in 400 grams of water using a homogenizer.

A polymeric latex was prepared by emulsion polymerization of styrene/butylacrylate/acrylic acid (82/18/2 parts) in a nonionic/anionic surfactant solution (3 percent) using ammonium persulfate as an initiator and dodecanethiol as a chain transfer agent. The emulsion was then polymerized at 70° C. for 8 hours. The resulting latex contained 40 percent of solids; the Tg of the latex dry sample was 53.0° C., as measured on DuPont DSC; $M_w$=24,000 and $M_n$=2,000 as determined on Hewlett Packard GPC. The zeta potential as measured on Pen Kem Inc. Laser Zee Meter was −85 millivolts. The particle size of the latex measured on Brookhaven Particle Nanosizer BI-90 was 151 nanometers.

PREPARATION OF TONER SIZE PARTICLES:

Preparation of the aggregated particles: 432.9 grams of the SUN FAST YELLOW™ dispersion were added simultaneously with 650 grams of latex into a SD41 continuous stirring device (Janke & Kunkel IKA Labortechnik) containing 600 milliliters of water with 2.9 grams of cationic surfactant alkylbenzyldimethyl ammonium chloride (SANIZOL B-50™). The pigment dispersion and the latex were well mixed by continuous pumping through the shearing chamber operating at 10,000 rpm for 8 minutes. This blend was then transferred into the kettle placed in the heating mantle and equipped with mechanical stirrer and temperature probe. The aggregation was performed at 45° C. for 90 minutes, while stirring at 650 rpm. Aggregates with the particle size of 4.9 with the GSD of 1.21 (as measured on the Coulter Counter) were obtained.

Coalescence of aggregated particles: after aggregation, the stirring speed was reduced from 650 to 250 rpm and 120 milliliters of 20 percent of anionic surfactant (NEOGEN R™) in water were added, and then the temperature was raised to 80° C. Aggregates of latex and pigment particles were coalesced at 80° C. for 3 hours. After 3 hours of heating, toner particles of 5.0 microns with 1.21 GSD were measured on the Coulter Counter. These results indicated that no additional growth of the particles occurred during the heating of aggregates at 80° C.

The toner particles were then washed by filtration using hot water (50° C.) and dried on the freeze dryer. The resulting toner particles were comprised of 95 percent of styrene (82 parts), butylacrylate (18 parts) and acrylic acid (2 parts) and yellow pigment, 5 percent by weight of toner. The yield of dry toner particles was 98 percent.

EXAMPLE IV

Pigment dispersion: 40 grams of wet cake of pigment SUN FAST RHODAMINE™ (Sun Chemicals) and 2.92 grams of cationic surfactant alkylbenzyldimethyl ammonium chloride (SANIZOL B-50™) were dispersed in 400 grams of water using a homogenizer.

A polymeric latex was prepared by emulsion polymerization of styrene/butylacrylate/acrylic acid (82/18/2 parts)in nonionic/anionic surfactant solution (3 percent) using ammonium persulfate as an initiator and dodecanethiol as a chain transfer agent. The emulsion was then polymerized at 70° C. for 8 hours. The resulting latex contained 60 percent of water and 40 percent of solids comprised of copolymer of poly(-styrene/butylacrylate/acrylic acid); the Tg of the latex dry sample was 53.0° C., as measured on DuPont DSC; $M_w$=24,000 and $M_n$=2,000 as determined on Hewlett Packard GPC. The zeta potential as measured on Pen Kem Inc. Laser Zee Meter was −85 millivolts. The particle size of the latex measured on Brookhaven Particle Nanosizer BI-90 was 151 nanometers.

PREPARATION OF TONER SIZE PARTICLES:

Preparation of the aggregated particles: 432.9 grams of the SUN FAST RHODAMINE™ dispersion were added simultaneously with 650 grams of the above latex into a SD41 continuous stirring device (Janke & Kunkel IKA Labortechnik) containing 600 milliliters of water with 2.9 grams of cationic surfactant alkylbenzyldimethyl ammonium chloride (SANIZOL B-50™). Pigment dispersion and the latex were well mixed by continuous pumping through the shearing chamber operating at 10,000 rpm for 8 minutes. This blend was then transferred into the kettle placed in the heating mantle and equipped with mechanical stirrer and temperature probe. The aggregation was performed at 45° C. for 90 minutes, while stirring at 650 rpm. Aggregates with the particle size of 5.4 with the GSD of 1.19 (as measured on the Coulter Counter) were obtained.

Coalescence of aggregated particles: after aggregation, the stirring speed was reduced from 650 to 250 rpm and 120 milliliters of 10 percent of anionic surfactant (NEOGEN R™) in water were added and the temperature was raised to 80° C. Aggregates of latex and pigment particles were coalesced at 80° C. for 3 hours. After 3 hours of heating, toner particles of 5.4 microns average volume diameter with 1.19 a GSD were measured on the Coulter Counter. These results indicated no additional growth of the particles, that is they remained at 5.4 microns in volume average diameter, was observed during the heating of aggregates at 80° C.

The toner was then washed by filtration using hot water (50° C.) and dried on the freeze dryer. The resulting toner was comprised of 93 percent of styrene (82 parts), butylacrylate (18 parts) and acrylic acid (2 parts), and magenta pigment, 7 percent by weight of toner. The yield of dry toner particles was 97 percent.

EXAMPLE V

Pigment dispersion: 280 grams of dry pigment PV FAST BLUE™ and 58.5 grams of cationic surfactant alkylbenzyldimethyl ammonium chloride (SANIZOL B-50™) were dispersed in 8,000 grams of water using a microfluidizer.

A polymeric latex was prepared by emulsion polymerization of styrene/butadiene/acrylic acid (86/12/2 parts) in a nonionic/anionic surfactant solution (3 percent) using potassium persulfate as an initiator and dodecanethiol as a chain transfer agent. The emulsion was then polymerized at 70° C. for 8 hours. The resulting latex contained 40 percent of solids comprised of copolymer of poly(styrene/butylacrylate/acrylic acid); the Tg of the latex dry sample was 53.0° C., as measured on DuPont DSC; $M_w$=46,600 and $M_n$=8,000 as determined on Hewlett Packard GPC. The zeta potential as measured on Pen Kem Inc. Laser Zee Meter was −85 millivolts. The particle size of the latex measured on Brookhaven Particle Nanosizer BI-90 was 141 nanometers.

PREPARATION OF TONER SIZE PARTICLES:

Preparation of the aggregated particles: 417 grams of the PV FAST BLUE™ dispersion were added simultaneously with 650 grams of latex into the SD41 continuous stirring device (Janke & Kunkel IKA Labortechnik) containing 600 milliliters of water with 2.9 grams of cationic surfactant alkylbenzyldimethyl ammonium chloride (SANIZOL B-50™). The pigment dispersion and the latex were well mixed by continuous pumping through the shearing chamber operating at 10,000 rpm for 8 minutes. This blend was then transferred into the kettle placed in the heating mantle and equipped with mechanical stirrer and temperature probe. The aggregation was performed at 45° C. for 3 hours, while stirring at 650 rpm. Aggregates with the particle size of 4.6 with the GSD of 1.33, as measured on the Coulter Counter, were obtained.

Coalescence of aggregated particles: after aggregation, the stirring speed was reduced as in Example IV and 70 milliliters of 10 percent artionic surfactant (NEOGEN R™) were added, and the temperature was raised to 80° C. Aggregates of latex and pigment particles were coalesced at 80° C. for 3 hours. The particle size was measured after 30 minutes of heating at 80° C., and the particles of 4.6 microns with GSD of 1.34 were obtained. After 3 hours of heating, particles of 4.6 microns with 1.35 GSD were measured on the Coulter Counter. These results indicated no additional growth of the particles were observed during the heating of aggregates at 80° C.

The resulting toner particles were comprised of 95 percent of styrene (86 parts), polybutadiene (12 parts) and polyacrylic acid (2 parts) and cyan pigment (5 percent by weight of toner). The toner particles were then washed by filtration using hot water (50° C.) and dried on the freeze dryer. The yield of dry toner particles was 98 percent.

COMPARATIVE EXAMPLE VA

Without Extra Anionic Surfactant Added Before Coalescence

Pigment dispersion: 280 grams of dry pigment PV FAST BLUE™ (Hoechst Chemicals) and 58.5 grams of cationic surfactant alkylbenzyldimethyl ammonium chloride (SANIZOL B-50™) were dispersed in 8,000 grams of water using a microfluidizer.

A polymeric latex was prepared by emulsion polymerization of styrene/butadiene/acrylic acid (86/12/2 parts) in nonionic/anionic surfactant solution (3 percent) using potassium persulfate as an initiator and dodecanethiol as a chain transfer agent. The emulsion was then polymerized at 70° C. for 8 hours. The resulting latex contained 40 percent of solids of poly(styrene/butadiene/acrylic acid); the Tg of the latex dry sample was 53.0° C., as measured on DuPont DSC; $M_w$=46,600 and $M_n$=8,000 as determined on Hewlett Packard GPC. The zeta potential as measured on Pen Kem Inc. Laser Zee Meter was −85 millivolts. The particle size of the latex measured on Brookhaven Particle Nanosizer BI-90 was 141 nanometers.

PREPARATION OF TONER SIZE PARTICLES:

Preparation of the aggregated particles: 417 grams of the PV FAST BLUE™ dispersion were added simultaneously with 650 grams of latex into the SD41 continuous stirring device (Janke & Kunkel IKA Labortechnik) containing 600 milliliters of water with 2.9 grams of cationic surfactant alkylbenzyldimethyl ammonium chloride (SANIZOL B-50™). The pigment dispersion and the latex were well mixed by continuous pumping through the shearing chamber operating at 10,000 rpm for 8 minutes. This blend was then transferred into the kettle placed in the heating mantle and equipped with mechanical stirrer and temperature probe. The aggregation was accomplished at 45° C. for 3 hours, while stirring at 650 rpm. Aggregates with the particle size of 4.6 with the GSD of 1.33, as measured on the Coulter Counter, were obtained.

Coalescence of aggregated particles: after aggregation, the temperature in the kettle was raised to 80° C., and the stirring speed reduced. Aggregates of latex and pigment particles were coalesced at 80° C. for 3 hours. The particle size was measured after 20 minutes of heating at 80° C., the particles of 7.0 microns with GSD of 1.26 were obtained. After 3 hours of heating, same size particles of 7.0 microns with 1.26 GSD were measured. These results indicated that due to the lack of stability of the colloidal system significant increase in particle size (almost double,) even after a very short time of heating, was observed. The size of the aggregates was not preserved in the heating stage (Tg), when temperature of the kettle was increased above the resin Tg and no extra stabilizing anionic surfactant was added.

The toner particles were then washed by filtration using hot water (50° C.) and dried on the freeze dryer. The resulting toner particles comprised of 95 percent of polystyrene (86 parts), polybutadiene (12 parts) and polyacrylic acid (2 parts), and cyan pigment (5 percent by weight of toner) with an average volume diameter of 7.6 microns and a GSD of 1.20 (compared to 4.6 microns and GSD of 1.33 achieved in the aggregation), indicating that without addition of extra anionic surfactant prior to heating, particle size and GSD achieved in the aggregation step were not retained during coalescence. The yield of dry toner particles was 99 percent.

EXAMPLE VI

Pigment dispersion: 280 grams of dry pigment PV FAST BLUE™ and 58.5 grams of cationic surfactant alkylbenzyldimethyl ammonium chloride (SANIZOL B-50™) were dispersed in 8,000 grams of water using a microfluidizer.

A polymeric latex was prepared by emulsion polymerization of styrene/butadiene/acrylic acid (86/12/2 parts)in nonionic/anionic surfactant solution (3 percent) using potassium persulfate as an initiator and dodecanethiol as a chain transfer agent. The emulsion was then polymerized at 70° C. for 8 hours. The resulting latex contained 40 percent of solids of poly(styrene/butadiene/acrylic acid); the Tg of the latex dry sample was 53.0° C., as measured on DuPont DSC; $M_w$=46,600 and $M_n$=8,000 as determined on Hewlett Packard GPC. The zeta potential as measured on Pen Kem Inc. Laser Zee Meter was −85 millivolts. The particle size of the latex measured on Brookhaven Particle Nanosizer BI-90 was 141 nanometers.

PREPARATION OF TONER SIZE PARTICLES:

Preparation of the aggregated particles: 417 grams of the PV FAST BLUE™ dispersion were added simultaneously with 650 grams of latex into the SD41 continuous stirring device (Janke & Kunkel IKA Labortechnik) containing 600 milliliters of water with 2.9 grams of cationic surfactant alkylbenzyldimethyl ammonium chloride (SANIZOL B-50™). Pigment dispersion and the latex were well mixed by continuous pumping through the shearing chamber operating at 10,000 rpm for 8 minutes. This blend was than transferred into the kettle placed in the heating mantle and equipped with mechanical stirrer and temperature probe. The aggregation was performed at 35° C. for 5 hours, while stirring at 650 rpm. Aggregates with the particle size of 3.5 with the GSD of 1.27 (as measured on the Coulter Counter) were obtained.

Coalescence of aggregated particles: after aggregation, the stirring speed was reduced to 250 rpm and 70 milliliters of 10 percent anionic surfactant (NEOGEN R™) in water were added, and the temperature was raised to 80° C. Aggregates of latex and pigment particles were coalesced at 80° C. for 3 hours. After 3 hours of heating, toner particles of 3.6 microns with 1.29 GSD were measured on the Coulter Counter. These results indicated that no further growth of the particles was observed during the heating of aggregates at 80° C. This was believed caused by the addition of extra anionic surfactant which increased the stability of the system components.

EXAMPLE VII

Pigment dispersion: 280 grams of dry pigment PV FAST BLUE™ and 58.5 grams of cationic surfactant alkylbenzyldimethyl ammonium chloride (SANIZOL B-50™) were dispersed in 8,000 grams of water using a microfluidizer.

A polymeric latex was prepared by emulsion polymerization of styrene/butadiene/acrylic acid (86/12/2 parts)in nonionic/anionic surfactant solution (3 percent) using potassium persulfate as an initiator and dodecanethiol as a chain transfer agent. The emulsion was then polymerized at 70° C. for 8 hours. The resulting latex contained 40 percent of solids of poly(styrene/butylacrylate/acrylic acid); the Tg of the latex dry sample was 53.0° C., as measured on DuPont DSC; $M_w$=46,600 and $M_n$=8,000 as determined on Hewlett Packard GPC. The zeta potential as measured on Pen Kem Inc. Laser Zee Meter was −85 millivolts. The particle size of the latex measured on Brookhaven Particle Nanosizer BI-90 was 141 nanometers.

PREPARATION OF TONER SIZE PARTICLES:

Preparation of the aggregated particles: 417 grams of the PV FAST BLUE™ dispersion were added simultaneously with 650 grams of latex into the SD41 continuous stirring device (Janke & Kunkel IKA Labortechnik) containing 600 milliliters of water with 2.9 grams of cationic surfactant alkylbenzyldimethyl ammonium chloride (SANIZOL B-50™). The pigment dispersion and the latex were well mixed by continuous pumping through the shearing chamber operating at 10,000 rpm for 8 minutes. This blend was then transferred into the kettle placed in the heating mantle and equipped with mechanical stirrer and temperature probe. The aggregation was performed at 35° C. for 20 hours, while stirring at 650 rpm. Aggregates with the particle size of 3.4 with a GSD of 1.26 (as measured on the Coulter Counter) were obtained.

Coalescence of aggregated particles: after aggregation, the stirring speed was reduced to 250 rpm and 35 milliliters of 10 percent anionic surfactant (NEOGEN R™) in water were added, and the temperature was raised to 80° C. Aggregates of latex and pigment particles were coalesced at 80° C. for 3 hours. After 3 hours of heating, particles of 3.4 microns with a 1.26 GSD were measured on the Coulter Counter. These results indicated that no further growth of the particles was observed during the heating of aggregates at 80° C.

EXAMPLE VIII

Pigment dispersion: 38 grams of SUN FAST BLUE™ pigment in the form of the wet cake (40 percent solids—which is equivalent to 15 grams of dry pigment) and 2.92 grams of cationic surfactant—alkylbenzyldimethyl ammonium chloride (SANIZOL B-50™) were dispersed in 377 grams of deionized water.

A polymeric latex was prepared in emulsion polymerization of styrene/butylacrylate/acrylic acid (82/18/2 parts)in nonionic/anionic surfactant solution (3 percent) as follows. 352 Grams of styrene, 48 grams of butylacrylate, 8 grams of acrylic acid, and 12 grams of dodecanethiol were mixed with 600 milliliters of deionized water in which 9 grams of sodium dodecyl benzene sulfonate anionic surfactant (NEOGEN R™ which contains 60 percent of active component), 8.6 grams of polyoxyethylene nonyl phenyl ether—nonionic surfactant (ANTAROX 897™—70 percent active), and 4 grams of ammonium persulfate initiator were dissolved. The emulsion was then polymerized at 70° C. for 8 hours. The resulting latex contained 40 percent of solids of poly(styrene/butylacrylate/acrylic acid); the Tg of the latex dry sample was 52° C., as measured on DuPont DSC; $M_w$=9,000, and $M_n$=2,000 as determined on Hewlett Packard GPC. The zeta potential as measured on Pen Kem Inc. Laser Zee Meter was −80 millivolts. The aforementioned latex was then selected for the toner preparation of Example VIII, and Examples VIII A and VIII B.

PREPARATION OF TONER SIZE PARTICLES:

Preparation of the aggregated particles: 417 grams of the PV FAST BLUE™ dispersion were added simultaneously with 650 grams of latex into the SD41 continuous stirring device (Janke & Kunkel IKA Labortechnik) containing 600 milliliters of water with 2.92 grams of cationic surfactant alkylbenzyldimethyl ammonium chloride (SANIZOL B-50™). The pigment dispersion and the latex were well mixed by continuous pumping through the shearing chamber operating at 10,000 rpm for 8 minutes, while 600 milliliters of water were added. This blend was than transferred into the kettle placed in the heating mantle and equipped with mechanical stirrer and temperature probe. The aggregation was performed at 45° C. while being stirred at 650 rpm for 3 hours. Aggregates with a particle size of 4.2 microns with GSD of 1.19 (as measured on the Coulter Counter) were obtained.

The aggregated mixture was divided into 3×700 gram batches. One batch of aggregated mixture (700 grams) was transferred into another kettle and 10 milliliters of 20 percent by weight of anionic surfactant (NEOGEN R™) in water was added while being stirred at 200 rpm, and the temperature was raised to 90° C. for 4 hours. After the coalescence, a toner particle size of 4.2 microns with GSD of 1.19 was measured on the Coulter Counter, which indicates that particle size achieved in the aggregation step was preserved. This is due to the increased colloidal stability of the aggregates, which is achieved by the addition of the extra anionic surfactant prior to raising the kettle temperature above the resin Tg to perform the coalescence and reduced stirring speed, it is believed. In the Comparative Examples, the amounts of the anionic surfactant were doubled from 10 milliliters of 20 percent to 20 milliliters of 20 percent anionic surfactant solution (Example VIIIA) or totally eliminated (Example VIIIB).

EXAMPLE VIIIA

Coalescence of aggregated particles: a second batch (700 grams) of aggregated mixture (prepared in Example VIII) was transferred into another kettle and 20 milliliters of 20 percent solution of anionic surfactant (NEOGEN R™) were added while being stirred at 200 rpm, and the temperature was raised to 90° C. Aggregates were coalesced at 90° C. for 4 hours. After the coalescence, a particle size of 3.8 microns with GSD of 1.22 was measured on the Coulter Counter, which indicates that if, for example, an excess of anionic surfactant is used, the process of aggregation can lead to break up of the aggregates resulting in an increase of fines, which are defined as particles of less than 1.5 microns. The mean average volume diameter particles size decreases, for example, from 4.2 microns to 3.8 microns, and this difference is observed in the increase of the number of fine particles as measured on the Coulter Counter.

EXAMPLE VIIIB

Coalescence of aggregated particles: a third batch (700 grams) of aggregated mixture (prepared in Example VIII) was transferred into another kettle and it was heated to 90° C. without addition of any extra anionic stabilizing surfactant while being stirred at 200 rpm. Aggregates were coalesced at 90° C. for 4 hours. After the coalescence, particle size of 9.5 microns with GSD of 1.19 were measured on the Coulter Counter. This comparative Example indicates that, for example, without addition of extra anionic surfactant, particles formed in the aggregation step tend to further increase in size (double their size) when heated above the resin Tg in the coalescence step, and hence the particle size cannot be retained.

In the following Examples, the particle size and GSD achieved in the aggregation step was retained in the coalescence due to the addition of extra nonionic surfactant rather than the anionic surfactant as a "freezing agent". Nonionic surfactants increase steric stability of the aggregated system (comprised of resin, pigment particles, optional charge control agents, water and anionic/nonionic/cationic surfactants), thus preventing further growth of particles in the coalescence step (heating above the resin Tg).

EXAMPLE IX

A polymeric latex was prepared in emulsion polymerization of styrene/butylacrylate/acrylic acid (82/18/2) in nonionic/anionic surfactant solution (NEOGEN R™/IGEPAL CA 897™, 3 percent). The latex contained 40 percent of solids; the Tg of the latex sample dried on the freeze dryer was 53.1° C.; $M_w$=20,200, $M_n$=5,800. The zeta potential was −80 millivolts, and this was sheared with the pigment dispersion of Example VIII.

Preparation of the aggregated particles: 5.85 grams of SANIZOL B-50™in 400 grams of deionized water were added simultaneously with 650 grams of the above latex into the SD41 continuous stirring device containing 600 grams of deionized water. The anionic latex and solution of the cationic surfactant were well mixed by continuous pumping through the SD41 operating at 10,000 rpm for 8 minutes. This blend was then transferred into a kettle and aggregated at 35° C. for 3 days. Particle size of the aggregates as measured using the Coulter Counter was 4.7 microns (GSD=1.26).

Coalescence of aggregated particles: 300 grams of this solution was transferred into a kettle and diluted with equal volume of 2 percent nonionic surfactant IGEPAL CA 897™. The kettle was heated up to 65° C., with stirring. The sample was retained at 65° C. for 3 hours and the particle size was measured on Coulter Counter (4.5 microns GSD of 1.33).

Then, the temperature in the kettle was raised to 85° C. and retained for another 2 hours. Particle size measurement at this point indicated particles of 4.4 microns with GSD of 1.32. Further particle growth in the coalescence step can be prevented, and resin, pigment, water, and anionic/nonionic/cationic surfactants have sufficient stability to withstand further heating up to 85° C.

COMPARATIVE EXAMPLE IXA

Coalescence of aggregated particles: the aggregated particles prepared in Example IX were placed in another kettle without addition of any extra surfactant. These particles were then heated up to 65° C. initially for 3 hours. Particle size measurement at this point indicated a particle size of 6.6 microns with GSD of 1.41. Further heating at 85° C. for an additional 2 hours indicated particles of 6.5 microns with GSD of 1.42. Thus, without the addition of extra stabilizer (surfactant) prior to coalescence, the particles have a tendency to increase their size from 4.7 to 6.6 microns while being heated above their Tg for coalescence, even when the temperature was raised only slightly above their Tg.

TABLE 1

Addition of Extra Anionic Surfactant to Preserve Particle Size and GSD Achieved in Aggregation Step Through the Coalescence (Heating Above Tg)

| PROCESS STAGE | PARTICLE SIZE | GSD |
|---|---|---|
| Aggregation | 4.4 μm | 1.21 |
| Anionic Surfactant Addition | 4.5 μm | 1.23 |
| Heating 1 hour, 80° C. | 4.5 μm | 1.23 |
| Heating 3 hours, 80° C. | 4.5 μm | 1.24 |
| Heating 3 hours, 80° C./Sonication | 4.4 μm | 1.23 |
| Comparative Example/No Surfactant | 7.6 μm | 1.20 |

Latex E/A 1-4: Resin—Styrene/BA/AA (82/18/2), Pigment—PV FAST BLUE™(5 percent).

The Table illustrates that by the addition of the extra anionic surfactant to the aggregates, there is enabled "freezing" the size of the aggregate particles as well as the particle size distribution (GSD) when the temperature is raised (5° C. to 50° C.) above the resin Tg (resin Tg=54° C. and is in the range of 60° C. to 95° C. to perform the coalescence). It also shows that when no extra anionic surfactant was added, the particle increased in size from 4.4 to 7.6 microns. Furthermore, upon sonification of the particles that were frozen by the addition of the anionic surfactant, the particle size and the GSD remained unchanged, indicating well coalesced particles.

Freezing in embodiments indicates that no changes in particle size or GSD is observed before or after the coalescence step when the temperature is raised above the Tg of the resin, where the Tg of the resin is 54° C. and the range is between 45° C. to 90° C. and the preferred range is between 50° C. and 80° C.

Other embodiments and modifications of the present invention may occur to those skilled in the art subsequent to a review of the information presented herein; these embodiments and modifications, as well as equivalents thereof, are also included within the scope of this invention.

What is claimed is:

1. A process for the preparation of toner compositions with a particle size of from about 1 to about 25 microns in average volume diameter consisting essentially of:

(i) preparing a pigment dispersion in water, which dispersion is comprised of a pigment, an ionic surfactant in amounts of from about 0.5 to about 10 percent by weight of water, and an optional charge control agent;

(ii) shearing the pigment dispersion with a latex mixture comprised of a counterionic surfactant with a charge polarity of opposite sign to that of said ionic surfactant, a nonionic surfactant, and resin particles, thereby causing a flocculation or heterocoagulation of pigment, resin particles, and optional charge control agent;

(iii) stirring the mixture of (ii) at from about 300 to about 1,000 revolutions per minute to form electrostatically bound substantially stable toner size aggregates with a narrow particle size distribution;

(iv) reducing the stirring speed in (iii) to from about 100 to about 600 revolutions per minute, and subsequently adding further ionic or nonionic surfactant in the range of from about 0.1 to about 10 percent by weight of water to prevent, or minimize further growth or enlargement of the toner size aggregates of (iii) in the coalescence step (v); and (v) heating and coalescing from about 5 to about 50° C. above about the resin glass transition temperature, Tg, which resin Tg is from between about 45° C. to about 90° C. the statically bound aggregated particles to form said toner composition comprised of resin particles, pigment and optional charge control agent.

2. A process in accordance with claim 1 wherein the surfactant utilized in preparing the pigment dispersion is a cationic surfactant in an amount of from about 0.01 weight percent to about 10 weight percent and the counterionic surfactant present in the latex mixture is an anionic surfactant present in an amount of from about 0.2 weight percent to about 5 weight percent; and wherein the molar ratio of cationic surfactant introduced with the pigment dispersion to the anionic surfactant introduced with the latex can be varied from about 0.5 to about 5.

3. A process in accordance with claim 2 wherein the cationic surfactant is a quaternary ammonium salt.

4. A process in accordance with claim 2 wherein the artionic surfactant concentration is about 0.1 to about 5 weight percent of the latex mixture of resin, pigment, optional charge control agent, and the cationic surfactant concentration is about 0.1 to about 5 weight percent of the aqueous phase of resin, pigment, and optional charge control agent.

5. A process in accordance with claim 1 wherein to prevent or minimize further growth or enlargement of the toner size aggregates of (iii) in the coalescing step (v) said ionic surfactant of (iv) is added.

6. A process in accordance with claim 1 wherein the addition of further ionic surfactant (iv) stabilizes the toner size aggregates of (iii) and as a result fixes their particle size and particle size distribution, and wherein the particle size is in the range of from about 3 to about 10 microns in average volume diameter, and the particle size distribution is in the range of from about 1.16 to about 1.26.

7. A process in accordance with claim 1 wherein the ionic surfactant added acts to increase the electrostatic repulsions between the aggregates, thereby increasing their stability, and wherein the aggregates formed have a volume average diameter of from about 3 to about 10 microns and do not grow further in size.

8. A process in accordance with claim 1 wherein to prevent or minimize further growth or enlargement of the toner size aggregates of (iii) in the coalescing step (v) there is added from about 0.02 percent to 5 percent by weight of water of said nonionic surfactant after aggregation (iii), and the speed in (iv) is reduced to from about 200 to about 600 revolutions per minute.

9. A process in accordance with claim 8 wherein the addition of nonionic surfactant further stabilizes the aggregated particles by steric repulsion and as a result fixes their size and particle size distribution as achieved in (iii) of from about 3 to about 10 microns, and wherein the GSD thereof is from about 1.20 to about 1.26.

10. A process in accordance with claim 1 wherein the ionic surfactant utilized for minimizing, or preventing particle growth in the coalescence step is comprised of sodium dodecyl benzene sulfonates.

11. A process in accordance with claim 1 wherein the nonionic surfactant (iv) utilized for controlling particle growth in the coalescence (v) is an alkyl phenoxypoly(ethylenoxy) ethanol.

12. A process in accordance with claim 1 wherein the surfactant utilized in preparing the pigment dispersion is an anionic surfactant, and the counterionic surfactant present in the latex mixture is a cationic surfactant.

13. A process in accordance with claim 1 wherein the dispersion of (i) is accomplished by homogenizing at from about 1,000 revolutions per minute to about 10,000 revolutions per minute at a temperature of from about 25° C. to about 35° C., and for a duration of from about 1 minute to about 120 minutes.

14. A process in accordance with claim 1 wherein the dispersion of (i) is accomplished by an ultrasonic probe at from about 300 watts to about 900 watts of energy, at from about 5 to about 50 megahertz of amplitude, at a temperature of from about 25° C. to about 55° C., and for a duration of from about 1 minute to about 120 minutes.

15. A process in accordance with claim 1 wherein the dispersion of (i) is accomplished by microfluidization in a microfluidizer or in nanojet for a duration of from about 1 minute to about 120 minutes.

16. A process in accordance with claim 1 wherein homogenization is accomplished in (ii) by homogenizing at from about 1,000 revolutions per minute to about 10,000 revolutions per minute, and for a duration of from about 1 minute to about 120 minutes.

17. A process in accordance with claim 1 wherein the heating of the statically bound aggregate particles to form toner size composite particles comprised of pigment, resin, and optional charge control agent is accomplished at a temperature of from about 60° C. to about 95° C., and for a duration of from about 1 hour to about 8 hours.

18. A process in accordance with claim 1 wherein the resin is selected from the group consisting of poly(styrene-butadiene), poly(paramethyl styrene-butadiene), poly(meta-methyl styrene-butadiene), poly(alpha-methylstyrene-butadiene), poly(methylmethacrylate-butadiene), poly(ethylmethacrylate-butadiene), poly(propylmethacrylate-butadiene), poly(butylmethacrylate-butadiene), poly(methylacrylate-butadiene), poly(ethylacrylate-butadiene), poly(propylacrylate-butadiene), poly(butylacrylate-butadiene), poly(styrene-isoprene), poly(para-methyl styrene-isoprene), poly(meta-methyl styrene-isoprene), poly(alphamethylstyrene-isoprene), poly(methylmethacrylate-isoprene), poly(ethylmethacrylate-isoprene), poly(propylmethacrylate-isoprene), poly(butylmethacrylate-isoprene), poly(methylacrylate-isoprene), poly(ethylacrylate-isoprene), poly(propylacrylate-isoprene), and poly(butylacrylate-isoprene).

19. A process in accordance with claim 1 wherein the resin is selected from the group consisting of poly(styrene-butadiene-acrylic acid), poly(styrene-butadiene-methacrylic acid), poly(styrene-butylmethacrylate-acrylic acid), poly(styrene-butylacrylate-acrylic acid), polyethylene-terephthalate, polypropylene-terephthalate, polybutylene-terephthalate, polypentylene-terephthalate, polyhexalene-terephthalate, polyheptadene-terephthalate, and polyoctalene-terephthalate.

20. A process in accordance with claim 1 wherein the nonionic surfactant is selected from the group consisting of polyvinyl alcohol, methalose, methyl cellulose, ethyl cellulose, propyl cellulose, hydroxy ethyl cellulose, carboxy methylcellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, and dialkyiphenoxy poly(ethyleneoxy) ethanol.

21. A process in accordance with claim 1 wherein the ionic surfactant is selected from the group consisting of sodium dodecyl sulfate, sodium dodecylbenzene sulfate and sodium dodecylnaphthalene sulfate.

22. A process in accordance with claim 1 wherein the resin is from about 0.01 to about 3 microns in average volume diameter, the pigment particles are from about 0.01 to about 1 micron in volume average diameter, the toner 98 is from about 3 to about 15 microns in average volume diameter, and the geometric size distribution thereof is from about 1.16 to about 1.30.

23. A process in accordance with claim 1 wherein the statically bound aggregate particles formed in (iii) are from about 1 to about 15 microns in average volume diameter.

24. A process in accordance with claim 1 wherein the nonionic surfactant concentration is about 0.1 to about 5 weight percent of the latex mixture.

25. A process in accordance with claim 1 wherein there is added to the surface of the formed toner composition of (v) additives of metal salts, metal salts of fatty acids, silicas, metal oxides, or mixtures thereof in an amount of from about 0.1 to about 10 weight percent of the obtained toner particles.

26. A process in accordance with claim 1 wherein diluting the flocculated mixture of (iii) is accomplished with water of from about 50 percent of solids to about 15 percent of solids, which solids are comprised of the resin latex and pigment particles.

27. A process in accordance with claim 1 wherein the formed toner composition of (v) is washed with warm water and the surfactants are removed from the formed toner composition of (v) surface, followed by drying.

28. A process in accordance with claim 1 wherein in (iv) said speed is reduced to from about 100 to about 200 revolutions per minute.

29. A process in accordance with claim 1 wherein said speed in (iv) is reduced to about 250 rpm from about 650 rpm in (iii).

30. A process for the preparation of toner compositions with a size of from about 1 to about 25 microns in average volume diameter comprising:

(i) preparing a pigment dispersion in water, which dispersion is comprised of a pigment and an ionic surfactant;

(ii) shearing the pigment dispersion with a latex mixture comprised of a counterionic surfactant with a charge polarity of opposite sign to that of said ionic surfactant, a nonionic surfactant, and resin, thereby causing a flocculation or heterocoagulation of the pigment and resin;

(iii) stirring the sheared mixture at about 300 to about 1,000 rpm to form electrostatically bound stable toner size aggregates with narrow particle size distribution, which aggregates are of a particle size in the range of about 3 to about 10 microns in average volume diameter, and wherein said narrow particle size distribution or GSD is from about 1.16 to about 1.26;

(iv) reducing the stirring speed to from about 200 to about 600 revolutions per minute and subsequently optionally adding additional ionic or nonionic surfactant in the range of from about 0.1 to 10 percent by weight, or water primarily to prevent further growth of the particles in the coalescence step (v); and (v) heating and coalescing from about 5° C. to about 50° C. above the resin Tg, which resin Tg is between about 45° C. and about 90° C., the statically bound aggregated particles to form said toner composition comprised of polymeric resin and pigment.

31. A process in accordance with claim 30 wherein the size of the particles in (iv) is from about 3 to about 10 microns in average volume diameter, and the GSD is from about 1.16 to about 1.26.

32. A process for the preparation of toner consisting essentially of:

(i) preparing a pigment dispersion in water, which dispersion is comprised of a pigment, and an ionic surfactant in amounts of from about 0.5 percent to about 10 percent based on the amount of water;

(ii) shearing the pigment dispersion with a latex mixture comprised of a counterionic surfactant with a charge polarity of opposite sign to that of said ionic surfactant, a nonionic surfactant, and resin, thereby causing a flocculation or heterocoagulation of the pigment and resin;

(iii) further stirring of the resulting mixture to form electrostatically bound relatively stable toner size aggregates with a narrow particle size distribution;

(iv) adding further surfactant to minimize further growth, or freeze the particle .size in the coalescence step (v), which size is from about 3 to about 10 microns in average volume diameter with a GSD of from about 1.16 to about 1.26; and (v) heating and coalescing, above the resin Tg the statically bound aggregated particles to form a toner composition comprised of resin and pigment.

33. A process for the preparation of toner compositions with a particle size of from about 3 to about 10 microns in average volume diameter consisting essentially of:

(i) preparing a pigment dispersion in water, which dispersion is comprised of a pigment, an ionic surfactant in amounts of from about 0.5 to about 10 percent by weight of water, and an optional charge control agent;

(ii) shearing the pigment dispersion with a latex mixture comprised of a counterionic surfactant with a charge polarity of opposite sign to that of said ionic surfactant, a nonionic surfactant, and resin particles, thereby causing a flocculation or heterocoagulation of pigment, resin particles, and optional charge control agent;

(iii) stirring the mixture of (ii) at from about 300 to about 1,000 revolutions per minute to form electrostatically bound substantially stable toner size aggregates with a narrow particle size distribution, and wherein said stable toner size aggregates have a particle size in the range of from 3 to 10 microns in average volume diameter, and wherein said narrow particle size distribution is from about 1.16 to about 1.26;

(iv) reducing the stirring speed in (iii) to from about 100 to about 600 revolutions per minute, and subsequently adding further ionic or nonionic surfactant in the range of from about 0.1 to about 10 percent by weight of water to prevent, or minimize further growth or enlargement of the toner size aggregates of (iii) in the coalescing step (v); and (v) heating and coalescing at from about 5° to about 50° C. above about the resin glass transition temperature, which resin glass transition temperature is from between about 45° C. to about 90° C. the electrostatically bound aggregated particles to form said toner composition comprised of resin particles, pigment particles and optional charge control agent particles.

34. A process in accordance with claim 30 wherein the ionic or nonionic surfactant is selected in an amount of about 0.1 to about 5 percent by weight.

* * * * *